US005695066A

United States Patent [19]

Bartlett

[11] Patent Number: 5,695,066

[45] Date of Patent: Dec. 9, 1997

[54] KIT AND PROCESS FOR USE IN MAKING A PERSONALIZED MEMENTO

[76] Inventor: James R. Bartlett, P.O. Box 618226, Orlando, Fla. 32861

[21] Appl. No.: 778,171

[22] Filed: Jan. 2, 1997

[51] Int. Cl.[6] ..... B65D 85/00

[52] U.S. Cl. ..... 206/575; 425/317

[58] Field of Search ..... 206/223, 575, 206/579, 457; 264/313; 425/317

[56] References Cited

U.S. PATENT DOCUMENTS

| | | | |
|---|---|---|---|
| 3,540,973 | 11/1970 | Johnson | 161/19 |
| 4,767,009 | 8/1988 | Hornecker et al. | 206/575 |
| 4,777,745 | 10/1988 | Rose | 40/152 |
| 4,828,116 | 5/1989 | Garcia | 206/575 |
| 4,888,251 | 12/1989 | Nakada | 428/542.4 |
| 4,946,039 | 8/1990 | Garran | 206/575 |
| 5,419,589 | 5/1995 | Fattore | 283/62 |

*Primary Examiner*—Jacob K. Ackun

[57] ABSTRACT

A kit and a process for use in making a highly personalized memento wherein the kit includes a supply of impression material and plaster material so that, the impression material, when combined with water, may be applied directly to the hands or feet of a subject creating an impression which, when removed from the subject a mixture of the plaster material and water may be poured into the impression and allowed to set, creating a reproduction of the subjects hand prints or footprints which may then be affixed to a plaque member along with a photograph of the subject and a nameplate on which is recorded information about that subject.

5 Claims, 2 Drawing Sheets

KIT AND PROCESS FOR USE IN MAKING A PERSONALIZED MEMENTO

BACKGROUND OF THE INVENTION

1. Field of Invention

This invention relates to a kit and a process for making a personalized memento and is more particularly concerned with a novel combination of personal elements.

The personalized memento consists of a plaque, on which is affixed a three dimensional representation of a subjects hand prints or foot prints, a devise for holding in place a photograph of said subject and a name plate on which information about the subject is recorded.

2. Description of Prior Art

A preliminary search relating to the subject invention produced the following U.S. Pat. Nos. 3,540,973; 4,777,745; 4,828,116; 4,888,251; 5,419,589.

Various types of processes and devices for making mementos and keepsakes are provided in prior art. For example, the apparatus of U.S. Pat. No. 3,540,973 describes an improvement to the process of creating bronzed baby shoes. In recent years, due in large part to the use of strong chemicals required to produce this memento and an ever increasing concern for the environment and how these chemicals are disposed of, the practice of creating this memento has dwindled.

The apparatus of U.S. Pat. No. 4,888,251 describes a personal memento designed to hold a child's tooth. While most parents may save a tooth that has fallen out, childhood mementos generally include a photograph to show how the child appeared at the time the memento was created. The apparatus in the above patent provides no means of displaying a photograph of the child in conjunction with the tooth.

U.S. Pat. No. 4,828,116 was granted to a kit for making a representation of a portion of a persons body. This kit allows the user to produce an artistic representation of a portion of a persons body, such as their face, foot or hand. The process requires that the portion of the body to be reproduced, be placed in a container or cavity defining mold member. This would limit the size and orientation of the body part to be reproduced to a size less then that of the cavity defining mold member. This process would also make if difficult if not impossible to make a reproduction of a child's or infants hands or feet because once the child's hand or foot is placed inside the cavity defining mold member the child must remain perfectly still until the mold material completely sets. If the child moves while the mold material is setting the resulting impression will be unusable. This kit also provides no means by which to associate the finished artistic representation of the body part with a particular person. There is no means provided to affix a name to the finished body part nor is there a means to record when the body part was created. There also is no provision made for attaching a photograph to the finished body part. Only the person who made the cast would know who made it or when it was made.

No prior art was found with respect to making a personalized memento containing a reproduction of the foot or paws of a family pet or animal.

As such, it may be appreciated that there continues to be a need for a new and improved method of creating a personalized memento wherein the name of the subject, the date the memento was created, the likeness of the subject and the three dimensional representation of a subjects hand prints or foot prints can be provided for along with ease of creating the memento. To this end a kit and process is set forth for creating a unique and novel personalized memento and in this respect, the present invention substantially fulfills this need.

OBJECTS AND ADVANTAGES

Accordingly it is an object of the present invention to provide a new and improved method of making a personalized memento requiring no special skills.

A further object of the present invention is to provide a kit and a process for creating a highly personalized memento consisting of a plaque, on which is affixed a three dimensional representation of a portion of the subjects body, wherein the kit includes a supply of impression material, a supply of plaster material, also a supply of metallic colored paint, whereby the impression material is applied directly to the portion of the body to be reproduced creating an impression into which the plaster material is poured and allowed to set so that when the impression material is removed, the representation of the portion of the subjects body part is achieved, which can then be painted with the metallic colored paint. Yet another object of the present invention is to provide a kit containing the essential materials and instructions used in making this personalized memento.

Still another object of the present invention is to provide a kit and a process for creating a highly personalized memento by including a photograph holder by which a likeness of the subject whose three dimensional hand or foot representation was made may be affixed to the memento.

Still another object of the present invention is to provide a kit and a process for creating a highly personalized memento by including a nameplate on which information such as a name and date are recorded about the subject and then said nameplate can be affixed to the memento.

It is also an object of this invention to provide a kit and a novel process for creating a three dimensional reproduction of a subjects hands or feet by applying the impression material directly to the hands or feet of the subject. Prior art processes relied on the use of a container to hold the impression material. This container has always limited the size and orientation of the subject and the subjects ability to move while the impression is being made, this novel process thus eliminates the need for any type of trays or cavity defining mold member to contain the impression material and permits free movement of the subject while the impression is being made.

It is also an object of this invention to provide a supply of metallic colored paint with which the three dimensional reproduction of the subjects body part may be painted, thus giving the finished three dimensional reproduction the appearance of having been made with a more expensive and more difficult metal process and also creating a more desirable reproduction.

It is also an object of this invention to provide a kit and a process for creating a three dimensional reproduction of an animals paws or feet, which when combined with other objects of this invention would create a highly personalized memento of a family pet or animal.

It is also an object of this invention to create a highly personalized memento according to the previous objects, but adapted for hanging.

It is also an object of this invention to create a highly personalized memento according to the previous objects, but adapted for standing on a flat surface.

It is also an object of this invention to create a highly personalized identification devise by having a photograph or likeness of the subject combined with a three dimensional reproduction of the subjects hand prints or footprints taken on a known date, with said hand print containing finger prints that are unique to that subject and said footprints reproduction containing footprints which are unique to that subject.

Various further and more specific purposes, features and advantages will clearly appear from the detailed description given below taken in connection with the accompanying drawings which form a part of the specifications and illustrate merely by way of example a preferred embodiment of the invention.

DRAWING FIGURES

SUMMARY OF THE INVENTION

Figure 1:
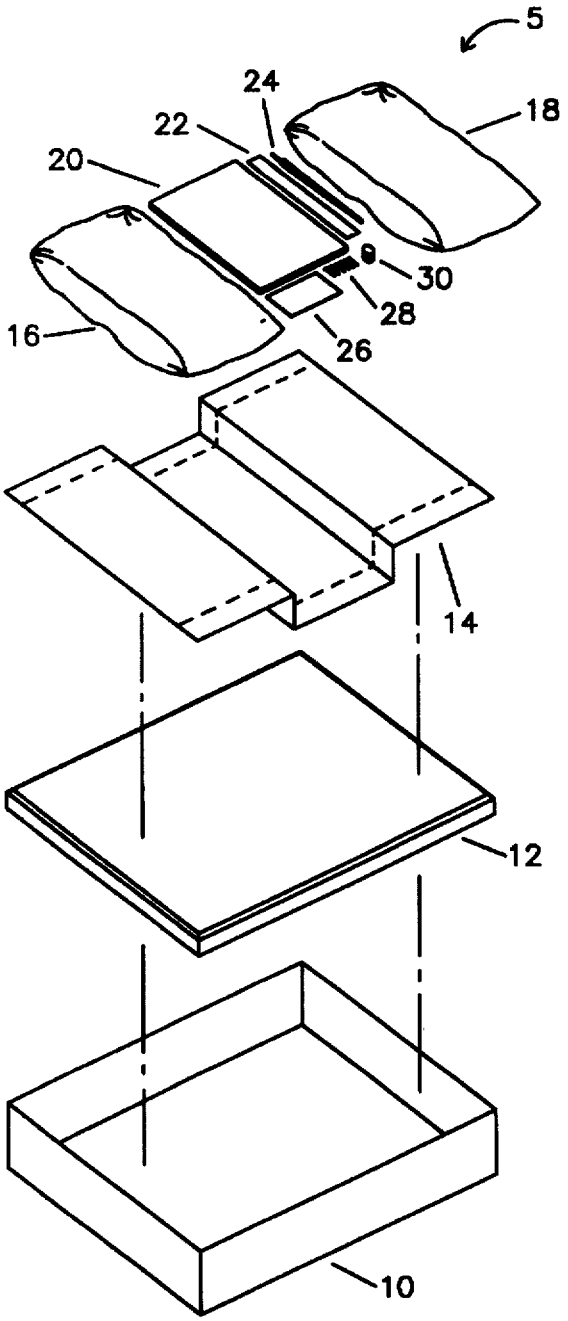
FIG. 1 is an exploded perspective view of a representation of a kit constructed in accordance with the invention and including the items specified more fully hereinafter.

Accordingly it is an objective of the subject invention to provide a means of producing and displaying a highly personalized memento consisting of a plaque, on which is mounted a three dimensional representation of a subjects hand print or foot print, preferably with a metallic like finish. Also on the plaque is a photograph holder to hold a likeness of the subject and a name plate on which is recorded information about the subject.

DESCRIPTION OF THE PREFERRED EMBODIMENT

While the subject invention is susceptible to embodiment in different forms, there is shown in the drawings and will herein under be described a preferred embodiment with the understanding that the present disclosure is to be considered as an exemplification of the invention and is not intended to limit the invention to the embodiment illustrated.

With reference to FIG. 1, therein is illustrated a kit 5 for creating a highly personalized memento according to the method of the present invention. As will be described in greater detail hereinafter, the kit includes the necessary materials for creating the highly personalized memento and such materials are contained or stored within a box 10.

Within the box 10 and as part of the kit, various items are provided for carrying our the process set forth more fully hereinafter. First, a plaque 12 is included in the kit 5. A separating device 14 is included to keep the various items in place while in the box 10. Also within the box is a supply of plaster material 16, preferably in a plastic bag and a supply of impression material 18, preferably in a plastic bag. Also included is a photo holder 20, which is to be affixed to the plaque 12 and used to display a likeness of the subject. A double coated adhesive strip 22 is included and is used to affix the three dimensional representation 32, shown in FIG. 2, to the plaque 12. The kit 5 includes a paint brush 24 and a supply of metallic colored paint 30 to be used to paint the three dimensional representation 32. A nameplate 26, preferably made of metal or plastic is included and a plurality of mechanical fasteners 28 used to affix the nameplate 26 and photo holder 20 to the plaque 12.

Figure 2:
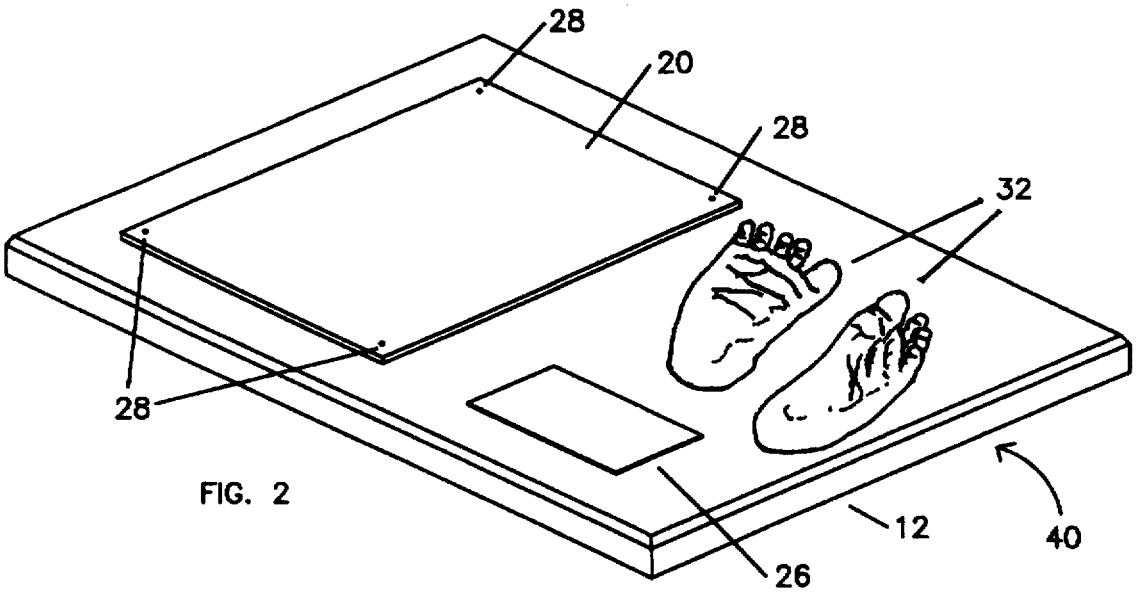
FIG. 2 is a perspective view of a representative product of the kit and the process.
Figure 3:
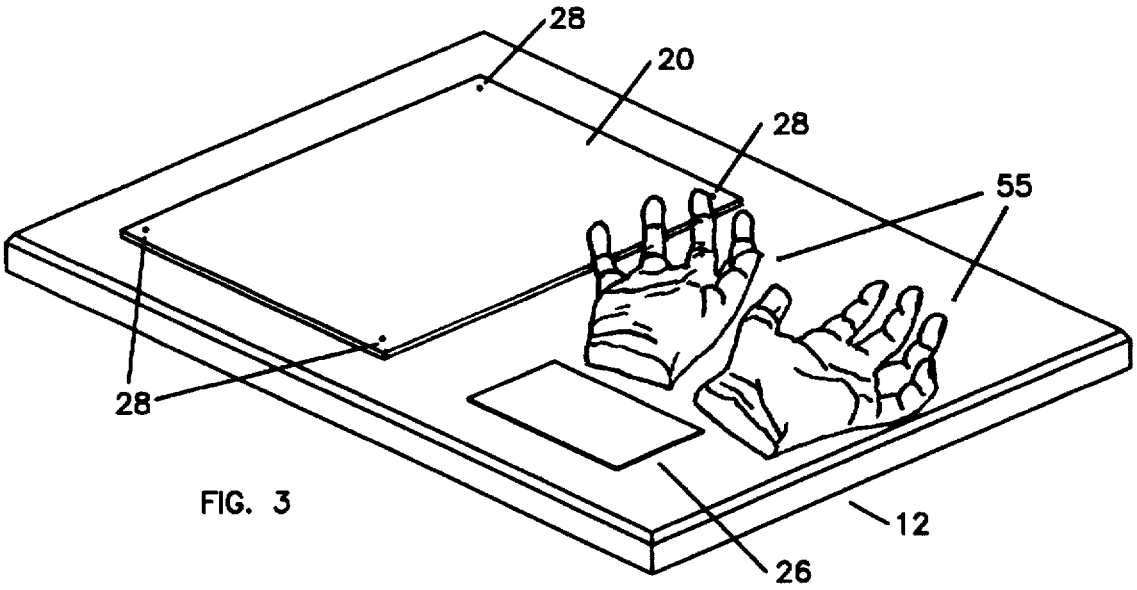
FIG. 3 is a perspective view of a representative product of the kit and process different from FIG. 2.

With reference to FIG. 2 there is illustrated a perspective view of a representative product of the kit and the process. The personalized memento 40, illustrated includes a generally rectangular plaque member 12. Plaque member 12 is of substantially rigid construction, and may be suitably fabricated from wood, wood products, plastic, or metallic materials.

Figure 5:
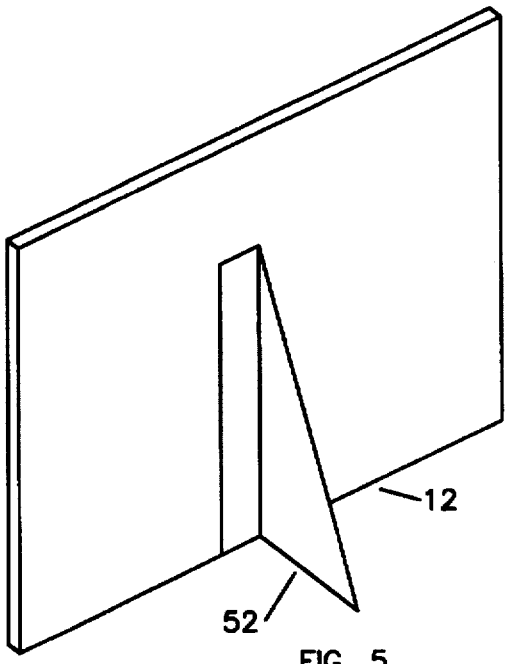
FIG. 5 is a perspective view of the back of the product different from FIG. 4
Figure 4:
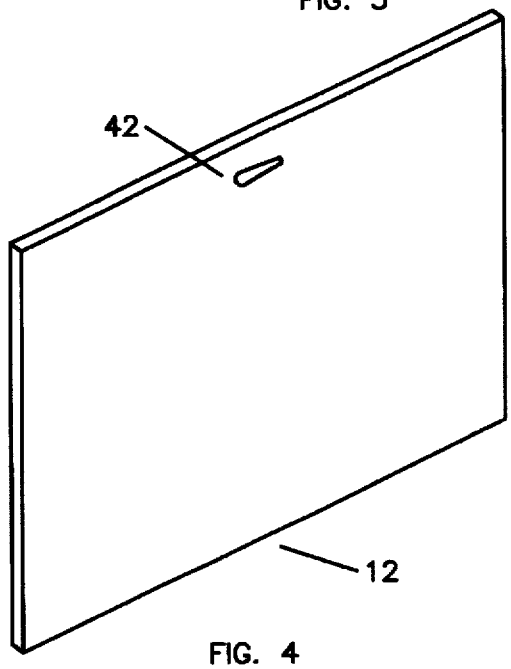
FIG. 4 is a perspective view of the back of the product.

With reference now to FIG. 4, the plaque member 12, is shown as including suitable arrangements for facilitating display. A suitable wall hanger 42 is provided on the rear surface of the plaque member 12 so that the personalized memento may be easily and conveniently hung on a wall or other vertical surface for display of the personalized memento. With reference to FIG. 5, a support stand 52 is shown, fabricated from wood or metal or the like, which can be suitably affixed to the rear surface of the plaque member 12 by me mechanical fasteners. This support stand 52 is dimensioned such that the plaque member 12 is maintained in inclined relation to a horizontal surface upon which the plaque member is placed.

With reference again to FIG. 2, a photo holder 20 is affixed to the plaque member 12, photo holder 20 preferably is made of transparent acrylic with a hole placed near each of the four corners, the hole is of such size to accommodate a mechanical fastener 28. The photo holder 20 would preferably be of such size and shape that when placed over a photo of the subject who's feet or hands have been reproduced and said photo holder 20 is then affixed to the plaque member 12, said photo holder 20 will completely cover the photo and allow the likeness of the subject to be viewed. A nameplate 26, preferably is made of metal, once the information about the subject has been recorded on the nameplate 26 it may then be affixed to the plaque member 12 by means of the double coated adhesive 22 or by mechanical fasteners 28 through holes provided in the nameplate.

A reproduction of a subjects feet 32 are affixed to the plaque member 12. The reproduction 32 is preferably made by mixing one eight cup of impression material 18 with three forths cup of water and stirred until smooth. The preferred impression material is a product known commercially as "alginate", and when mixed as above produces a smooth cream like material. In the case of reproducing feet the mixed, cream like impression material 18 will be spread onto and around the foot of the subject. The impression material 18 will "set" or dry to a soft rubbery consistency in about one minute and then can be removed from the subjects foot like a slipper. A plaster material 16, preferably a material commercially known as "lab stone" or "lab plaster", is mixed with equal parts water and plaster material 16, then poured into the impression left in the impression material 18 after the foot was removed. The plaster material 16 will dry to a hard finish in about thirty minutes, after which the impression material 18 may be easily peeled away from the hardened plaster material 16 leaving a hard plaster reproduction of a subjects feet 32. The reproduction of a subjects feet can then be painted with the metallic paint 30 in order to give it the appearance of being metal. The reproduction of a subjects feet 32 now painted with the metallic paint 30 can be affixed to the plaque member 12 using the double coated adhesive 22. Various different items may be made using the kit and process as described above. For example, FIG. 5 illustrates a reproduction of the hands of a subject 55 made with the kit and process and finished with the metallic paint, and then affixed to the plaque member 12. Alternatively a person could choose to make a reproduction of the paws or feet of a beloved pet which could then be affixed to the plaque member 12 and become a highly treasured and personalized memento of this pet.

In any event, there has been provided a kit and a process for use in making a highly personalized memento consisting of a plaque with a three dimensional reproduction of a subjects hands or feet along with a photograph of the subject and a nameplate to record information about the subject. The kit embodies a novel process for obtaining an impression, that allows an impression to be made of even a young child or infant who previously would not have been able to make one because they could not hold still. The kit also embodies a novel combination of a highly personalized item combined with a photograph and record of who it is and when it was made.

From the foregoing, it will be observed that numerous variations and modifications may be effected without departing from the true spirit and scope of the novel concept of the subject invention. It will be understood that no limitation with respect to the specific apparatus illustrated herein is intended or should be inferred. It is of course intended to cover by the accompanying claims all such modifications as fall within the scope of the claims.

What is claimed is:

1. An improved kit and process for use in making a highly personalized memento comprising:

a container of sufficient size as to accommodate all of the materials necessary to the process, a substantially rigid plaque member having a generally flat planar surface, a transparent photograph holder of predetermined size a nameplate of predetermined size, a supply of plaster and impression material, said impression material to be mixed with water and applied directly to a portion of the subjects body to create an impression of that portion of the body, into which the plaster material, after having been mixed with water, is poured into and allowed to set and become hard, means for affixing said photograph holder to said plaque member, means for affixing said nameplate to said plaque member, means for affixing said reproduction of a portion of a subjects body to said plaque member.

2. The improved kit and process as set forth in claim 1 wherein said container includes a supply of metallic colored paint.

3. The improved kit and process as set forth in claim 1 wherein said impression material is composed of Alginate.

4. The improved kit and process as set forth in claim 1 wherein said plaque member includes a hanger means affixed to the plaque member for hanging said plaque member on a vertical surface.

5. The improved kit and process as set forth in claim 1 wherein said plaque member includes a plaque member stand means affixed to the back side of the plaque member for maintaining and displaying said plaque member in an upright position on a horizontal surface.

* * * * *